US005860310A

United States Patent [19]

Wokusch

[11] Patent Number: 5,860,310

[45] Date of Patent: Jan. 19, 1999

[54] MILL TRAIN HAVING AT LEAST ONE ROLL STAND WITH AN AC DRIVE SYSTEM

[75] Inventor: Johann Thomas Wokusch, Forchheim, Germany

[73] Assignee: Siemens Aktiengesellschaft, Munich, Germany

[21] Appl. No.: 806,048

[22] Filed: Feb. 25, 1997

[51] Int. Cl.[6] ..... B21B 35/14

[52] U.S. Cl. ..... 72/249; 72/29.1

[58] Field of Search ..... 72/249, 29.1, 234; 310/159–166

[56] References Cited

U.S. PATENT DOCUMENTS

| | | | |
|---|---|---|---|
| 4,882,923 | 11/1989 | Ichida et al. . | |
| 4,920,306 | 4/1990 | Mard et al. | 318/722 |
| 5,298,848 | 3/1994 | Ueda et al. | 318/811 |
| 5,373,194 | 12/1994 | Nakamura | 307/31 |
| 5,649,441 | 7/1997 | Granholm et al. | 72/249 |
| 5,664,205 | 9/1997 | Nguyen Phuoc et al. | 318/801 |

FOREIGN PATENT DOCUMENTS

| | | | |
|---|---|---|---|
| 6-198318 | 7/1994 | Japan | 72/29.1 |

OTHER PUBLICATIONS

AC Drive System in Cold Mill Train, K. Yamamoto, Iron and Steel Engineer, May, 1989.

Experience With AC Cycloconverters for High Horsepower Drive Mills, O. Hauch, Iron and Steel Engineer, Sep, 1989.

W.T. Lankford, Jr., et al., *The Making and Treating of Steel*, U.S. Steel, Section 4, pp. 812–839, 10th Edition (1985).

T. Sukagawa, et al., *Recent Microprocessor–Based Control for Motor Drives*, Hitachi Review, vol.34, No. 4 pp. 187–193 (1995).

H. Klautschek, *Grundiagen und Begriffe der Unrichtertechnik sowle der aligemeinen Drehfeldmaschine*, presented at the Fort–und Weiterbildungszentrum of the Technische Akademie, Esslingen, pp. 1–5 (1984).

*Primary Examiner*—Joseph J. Hail, III
*Assistant Examiner*—Ed Tolan
*Attorney, Agent, or Firm*—Hill & Simpson

[57] ABSTRACT

A mill train comprising: at least one roll stand for rolling rolling stock; at least one AC motor operatively coupled to the roll stand to drive same; and a controller for controlling the motor, wherein the motor speed is adjustable between a minimum speed ($n_{min}$) and a maximum speed ($n_{max}$); wherein the ratio of the maximum speed ($n_{max}$) to the minimum speed ($n_{min}$) lies within the range 2.0 and 8.0; and wherein the motor has a power output between the minimum speed ($n_{min}$) and the maximum speed ($n_{max}$) that deviates from the continuous output of the motor at the minimum speed.

26 Claims, 3 Drawing Sheets

MILL TRAIN HAVING AT LEAST ONE ROLL STAND WITH AN AC DRIVE SYSTEM

BACKGROUND OF THE INVENTION

The invention generally is directed to mill trains with at least one roll stand for rolling rolling stock, whereby the roll stand is driven by at least one A.C. motor (AC motor). More particularly, the invention is directed to mill trains having a great range of speed adjustment such as disclosed in U.S. Pat. No. 4,882,923, which is fully incorporated herein by reference.

The mill train disclosed in U.S. Pat. No. 4,882,923 comprises electric motors for driving at least one of the roll stands whose ratio of maximum to minimum rolling speed amounts to at least 3.0, but at most 10.0. It is expected of the drive motor that is disclosed in U.S. Pat. No. 4,882,923, and that is not regulated in any special way, that it exhibits an unchanging power output according to its continuous rated output in the described speed range. Given a A.C. motor, however, a range of control with constant power output can only be realized with an additional outlay of components that is all the greater the greater the range of control.

SUMMARY OF THE INVENTION

An object of the invention is to provide a mill train with roll stands driven by A.C. motors wherein the power data of the motors allow a more liberal design of the rolling programs than with traditional mill trains, particularly a more optimum design than the mill train disclosed by U.S. Pat. No. 4,882,923. A further desire is to keep the additional exertions, i.e. the costs for a great ratio of maximum rolling speed to minimum rolling speed lower than in traditional mill trains and to likewise improve the utilization of the installed drive equipment as well as the efficiency thereof.

This object is inventively achieved by a mill train comprising at least one roll stand for rolling rolling stock, whereby the roll stand is driven by at least one A.C. motor whose speed for rolling the rolling stock is adjustable, by means of a controller, between a minimum speed and a maximum speed, depending on the demands of the rolling process, the ratio of maximum speed to minimum speed lying between 2.0 and 8.0, and whereby the A.C. motor makes an output available that can be adapted to the rolling process, particularly in an optimum way, and that deviates from the continuous output of the A.C. motor at minimum speed or from the continuous rated output of the three-phase A.C. motor, i.e., for example, the continuous rated output as indicated on the rating plate of the A.C. motor.

The inventive mill train is especially advantageous in an embodiment as multi-stand mill train.

Whereas the mill train of U.S. Pat. No. 4,882,923 is fixed to an operating mode at the nominal power that the electric motors which drive it are capable of outputting as a continuous rated output at minimum speed, the power that is output according to the inventive mill train is not kept constant at this value, instead a variable power is output. In this way, it is possible to react in an especially flexible and optimum way to different rolling stock, for example with respect to different dimensions, temperature or steel quality.

In an advantageous development of the invention, the control of the A.C. motor allows a continuous output that is higher in a broad range of speed than the continuous output of the A.C. motor a minimum speed. Whereas in that regard, the electric motors of U.S. Pat. No. 4,882,923 are operated with nominal output, the advantageously fashioned mill train is operated with A.C. motors that run above their continuous rated output over an arbitrary time for selected rolling programs in the range between the minimum and maximum speeds. Insofar as the inventively offered power reserve is not utilized or is only partly utilized, it is possible to implement both the A.C. motors as well as the frequency converters that supply them on a smaller basis and more cost-beneficially than given a mill train according to U.S. Pat. No. 4,882,923.

In a further advantageous development of the invention, the available output of the A.C. motor is variable in the range between the minimum speed and the maximum speed. A different output value, as shown, for example, in FIG. 2 and in FIG. 5, is thus offered for different rolling programs.

It is provided in a further development of the invention that the A.C. motors briefly output a power $P_s$ that is higher than the continuous output P in the provided speed range, particularly 1.5 through 2.5 times the continuous output.

It is also provided that the short-term power output in a broad range of speeds lies above the short-term output at minimum speed $P_{s(min)}$ in a way analogous to that in which the continuous power output P lies above the continuous output $P_{(min)}$. The range of 1.5 through 1.75 times the continuous output is thereby especially advantageous for cold rolling and the range of 1.75 through 2.25 times the continuous output is especially advantageous for hot rolling. Enhanced dependability is thus achieved for rolling operations with shock-like stresses and demands resulting from accelerations and speed corrections. What is to be understood as a short-term output in the above sense is the output that the A.C. motor makes available without damage for a short time during rolling of the rolling stock, for example during rolling of a rolled strip.

The invention can be implemented with induction (asynchronous) motors or synchronous motors.

In an advantageous application of the invention, the A.C. motor is operated above the minimum speed with an output above its continuous output at minimum speed, whereby the ratio of maximum speed to minimum speed lies between 2.0 and 8.0.

In an especially advantageous embodiment, the ratio of maximum speed to minimum speed lies between 2.0 and 5.0. Although the range above a speed ratio of 5.0 enables an especially flexible operation of the mill train, especially great speed ratios lead to the necessity of providing greater added outlays for frequency converters and motors. Under this boundary condition, the range 2.0 through 5.0 has proven especially advantageous for the ratio of minimum speed to maximum speed (see FIG. 3).

In a further advantageous development, the A.C. motor, which is either a synchronous or an asynchronous motor, is operated in the speed range between the minimum speed and the maximum speed with an output that is higher than the continuous output of the A.C. motor at minimum speed and higher than the output of the electric motor at maximum speed, whereby the continuous output at maximum speed is equal to or greater than the continuous output at minimum speed.

In a further development of the invention, the A.C. motor in the speed range between the minimum speed and the maximum speed is analogously operated with a short-term output that is higher than the short-term output of the A.C. motor at minimum speed and that is higher than the short-term output of the A.C. motor at maximum speed, whereby the short-term output at maximum speed is equal to or less than the short-term output at minimum speed.

It is provided in the framework of the invention that the A.C. motor, when it is a synchronous motor, is regulated to the optimum active load output by a variable shift angle between the internal voltage and the stator current. An especially beneficial control of a rolling mill drive in the given speed range is thus possible. However, it is also provided that the internal voltage e is first boosted for increasing the output above the minimum speed and the phase position of the stator current is regulated up to the maximum value after the voltage limit of the frequency converter is reached. The physical characteristics of a synchronous motor are thus exploited particularly well.

It is provided in a further development of the invention that the phase position of the current is set such with the regulation that a phase angle between stator current $i_s$ and the electromotively generated internal voltage e is formed that is the same as the phase angle between the stator current $i_s$ and an imaginary internal voltage u. The imaginary internal voltage u is defined as the back emf on the counter-voltage for covering the vectorial sum of the voltages independent of active loss that is composed of the internal voltage e and the inductive voltage drop $i_s \cdot x_s$. $x_s$ is thereby the reactance of the stator winding of the three-phase A.C. motor. The inventively desired, optimum thus derives with its advantageous effects and the possibility of an advantageous, optimally great power output with reduced outlay and improved efficiency. The synchronous electric motor can, moreover, be designed optimally small, i.e. with a low moment of inertia.

In a further advantageous development of the invention, it is provided that the internal shift angle $\phi_i$, which derives as angle between the vectors of the internal voltage e and the stator current $i_s$, is set smaller than equal to 40°, particularly smaller than equal to 35°. A reliable operation of the synchronous motor derives particularly when the shift angle is set smaller than equal to 35°. To that end, it is also provided that the internal voltage drop-off is fixed to at most $\sqrt{2} \cdot e$, whereby the internal voltages e and u are boosted by a factor of maximally 1.22 with reference to the corresponding value at the minimum speed. This measure contributes to a better utilization of the appurtenances and to the reliable operation of the synchronous motor.

It is provided in an analogous application of the invention that, given an induction (asynchronous) drive motor, the motor is operated with a voltage reserve for covering the voltage drops at the highest speed and highest load, whereby the internal voltage e is boosted above the minimum speed with increasing speed in accord with the respectively existing voltage reserve. An optimum exploitation of the installed powers and an improvement of the efficiency thus derive for asynchronous motors and their frequency converters.

These and other features of the invention are discussed in greater detail below in the following detailed description of the presently preferred embodiments with reference to the accompanying drawings.

DETAILED DESCRIPTION OF THE PRESENTLY PREFERRED EMBODIMENTS

Figure 1:
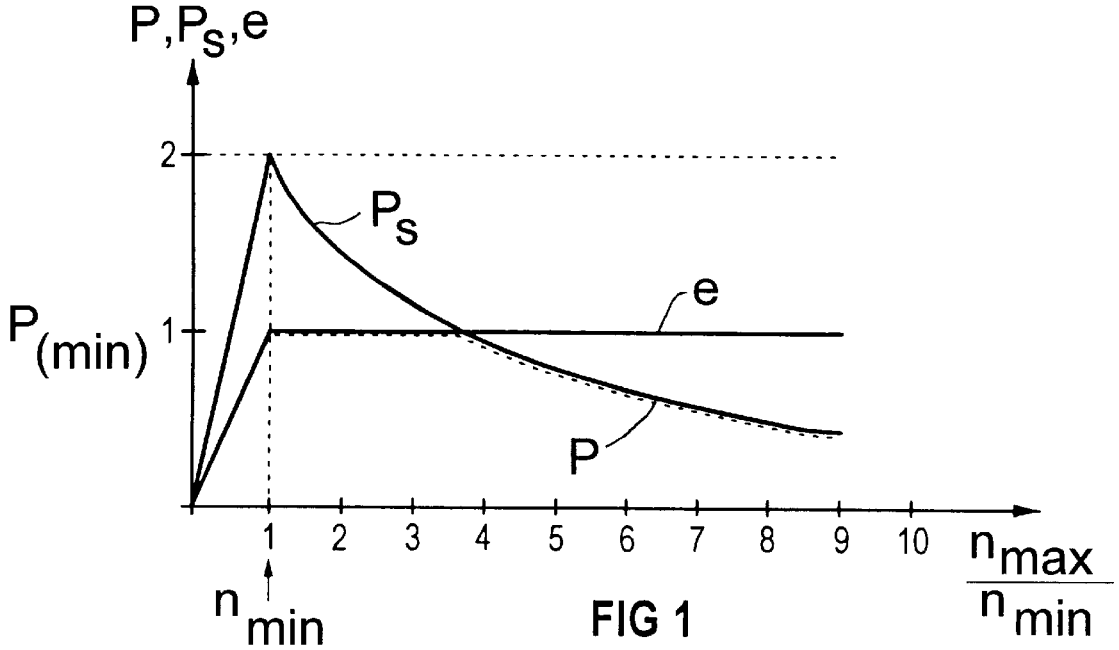
FIG. 1 illustrates the maximally available output of A.C. motors given constant voltage and an internal voltage e that is kept constant.

A range of speed control with an approximately constant power output is often required given drive motors for applications in the field of rolling mills. See, "*The Making, Shaping and Treating of Steel,* " Section 4, pp. 812–839 (1985, 110th Edition), W. T. Lankford, Jr., et al., Eds. Given, for example, drive motors of coilers for winding up rolled bands, a high speed with a low torque is required at the initial diameter but a low speed given a high torque is required at the final diameter. For constant band tension, this means an approximately constant output for the entire speed range of the winding operation. In coiling systems, for example in cold-rolling mills, this range of speed regulation, i.e. the ratio of minimum speed to maximum speed during operation, can amount to 1:5. An optimally great range of approximately constant output, however, is also desirable in many instance for drive motors of roll stands in order to have an appropriate latitude for designing the rolling programs. Rolling passes with slight reductions or, respectively, narrow bands require low torques but allow high rolling speeds. Conversely, rolling passes with great reductions or, respectively, wide bands with high torque requirements can only be achieved with correspondingly limited speed. A speed range up to 1:10 can be desirable for such applications (U.S. Pat. No. 4,882,923).

It is known from D.C. motors that a range of constant output can be relatively simply realized by attenuating the magnetic field, namely in such a way that, after reaching the speed for full output, the flux $\Phi$ of the motor is reduced such by adjusting the excitation current given a speed that continues to increase that the electromotively generated internal voltage e of the machine remains constant: $e=\Phi \cdot n$.

Given a constant internal voltage e, the motor can also be operated with unchanging voltage given the same armature current of the D.C. motor and the output, which is formed by the product of the armature current i and the internal voltage e, remains constant: $P=i \cdot e$.

For physical reasons, an operating range of constant output, given a terminal voltage that remains constant and a current that remains constant, fundamentally cannot be realized given an A.C. motor. It is in fact possible to set the effective flux of the A.C. motor by appropriate measures in the regulation of the motor, i.e. to also keep the internal voltage e of the A.C. motor constant over a specific speed range as in the case of the D.C. motor and to thus increase the speed above a minimum speed $n_N$.

The inductive voltage drops represent the problem. In addition to being determined by the electromotively generated internal voltage e, the voltage requirement of the A.C. motor is especially determined by the voltage drops at the reactance $x_s$ of the stator winding of the motor. (With an induction motor, the voltage drops at the ohmic resistors and at the reactance of the rotor winding play a comparatively less important part The reactance $x_s$ derives from the effective inductance $L_s$ of the stator winding and the frequency of the motor, according to: $x_s=2\pi f \cdot L_s$, f being the operating frequency of the motor. The operating frequency f changes with the speed of the motor. The inductive voltage drop is dependent on the stator current. It is calculated from $i_s \cdot x_s$ and is vectorially added to the internal voltage e of the motor.

The voltage drop is $i_s \cdot x_s$ is, therefore, dependent on the frequency and, thus, on the speed in addition to being dependent on the load. When the voltage of motor and feeding frequency converter is then selected such that all voltage drops are covered given a minimum speed and a desired, maximum short-term power output $P_s$, then the stator current must be reduced given increasing speeds because of the increasing reactance, and an available short-term output $P_s$ according to FIG. 1 derives given a voltage that remains constant and given an internal voltage e that is constantly regulated. The available short-term output drops sharply with the speed. Given greater speed ranges, it can even fall below the continuous output $P_{(min)}$ available at the minimum speed.

An output factor equal to 1 can be achieved with a synchronous motor given appropriate regulation of the phase position of the stator current. Compared to an induction (asynchronous) motor, the required output in the feeding frequency converter can thus be reduced. What is disadvantageous, however, is that a drop in output similar to FIG. 1 also derives for the synchronous motor for a specific frequency converter output and operation with the output factor equal to 1.

In a regulated three-phase motor, the voltage requirement increasing with the speed can be covered by appropriate voltage measures in the feeding frequency converter. What is thereby disadvantageous, however, is that extremely great voltage reserves and, thus, output reserves in the frequency converter and in the motor are thereby required, and that these are very poorly exploited given constant power output above the minimum speed. Given drives with very large ranges of speed control, the degree of utilization can drop to below 50%.

This poor utilization of frequency converter and motor, which is accompanied by higher dissipated powers, leads to high capital costs and also raises the operating costs. With reference to the example of a traditional three-phase A.C. induction motor for a cold-rolling mill, FIG. 3, reference numeral 1 illustrates how the expenses increase dependent on the relationship of maximum to minimum speed.

In order to avoid these disadvantages, it is proposed:

1. For An Induction (Asynchronous) Motor

Voltage reserves are provided for covering the internal voltage drops for a loading of the motor with the short-term load $P_{s(max)}$ at the maximum speed.

The induction motor, however, is not operated with constant internal voltage e and constant output on the basis of corresponding determinations in the regulation of the motor voltage and the regulation of the phase position of the current in the region above the minimum speed, but is operated in the speed range wherein the provided voltage reserve is not required for covering the inductive voltage drops such that the internal voltage e above the minimum speed $n_{min}$, given what is still the full magnetic flux, continues to be increased with increasing speed corresponding to the existing reserves, up to the internal voltage $e_D$ that is achieved with the maximally usable frequency converter voltage at the speed $n_D$. As a result, a power characteristic having a non-constant output derives for a constant stator current, according to FIG. 2 by way of example. The induction motor is thus inventively operated in a broad speed range above its continuous output $P_{(min)}$ at minimum speed, namely maximally with the output $P_D$ (or, respectively, for a short time with $P_{SD}$) The output $P_D$ results as design rating according to this method at the speed $n_D$.

Figure 2:
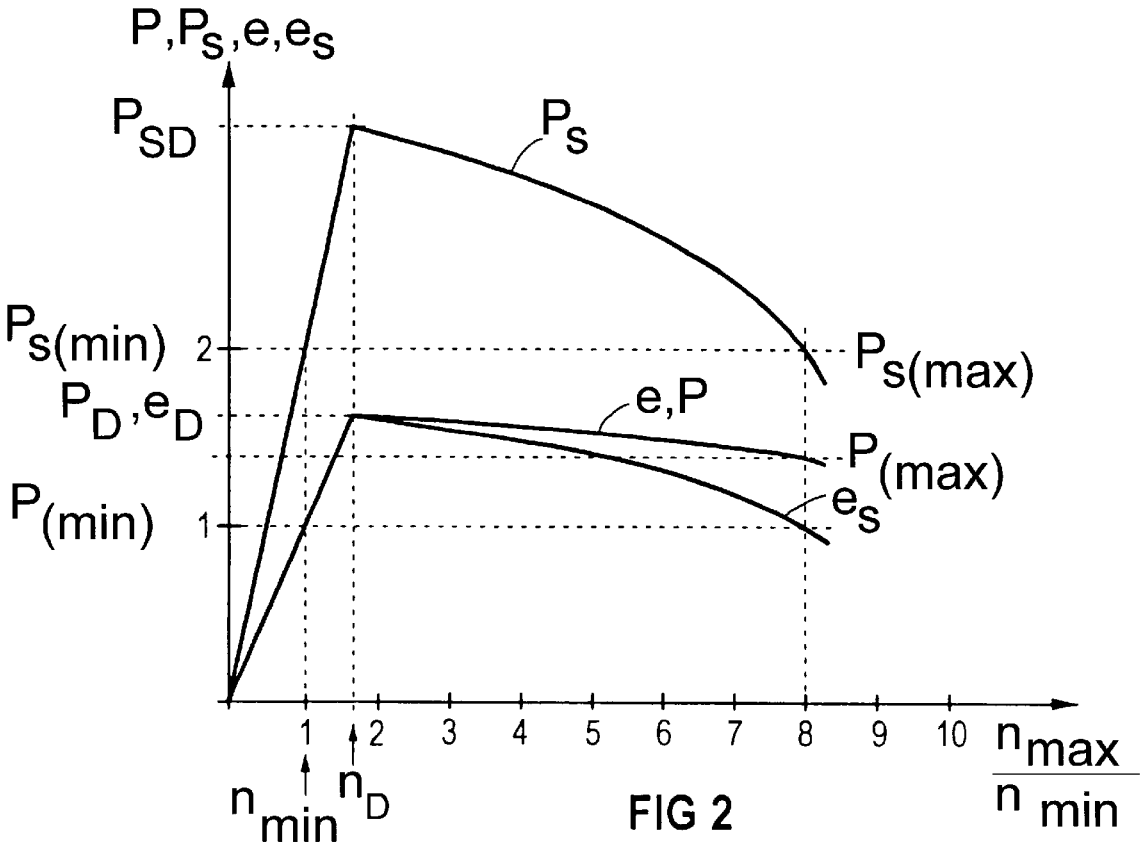
FIG. 2 illustrates an output characteristic of an asynchronous motor given regulation in accordance with the invention.

In FIG. 2, the line e shows the curve of the internal voltage e given the continuous output P and the line es shows the curve given the short-term output $P_s$.

The solution offers the following advantages:

a) An output reserve that can be utilized for designing rolling programs is available for a broad speed range. The degrees to which a motor and frequency converter can be utilized and their efficiencies are decisively improved.

b) Given operation with an output requirement below the available output, a reduction of the consumed current in the relationship of the required output to the available output derives within a broad speed range. The thermal stressing of A.C. motor and frequency converter is reduced. Taking the required short-term output into consideration and corresponding to the anticipated alternations of load and the resultant, low effective current load, the possibility thereby derives of selecting a smaller three-phase A.C. motor and of also reducing the size of component parts of the frequency converter.

2. For A Synchronous Motor

For applications that require a high ratio of minimum to maximum rolling speed, it is proposed to employ a synchronous motor and to thereby optimize the active load output on the basis of a variable shift angle between the internal voltage e and the stator current $i_s$. To that end, it is proposed that the phase position of the current $i_s$ is set on the basis of a regulation of the phase position of the stator current such that a phase angle derives between the stator current $i_s$ and the electromotively generated internal voltage e (=internal shift angle $\phi_i$) that is the same as the phase angle between the stator current $i_s$ and the imaginary internal voltage u. The internal voltage u is defined as counter-voltage or back voltage for covering the vectorial sum of the voltages independent of active loss that is composed of the internal voltage e and the inductive voltage drop $i_s \cdot x_s$, i.e. the product of the stator current is and the motor reactance $x_s$.

It is thereby simultaneously determined that the internal shift angle $\phi_i$ is a shift angle not greater than 35°, that the inductive voltage drop is $i_s \cdot x_s$ is not greater than $\sqrt{2} \cdot e$, and that, further, the electromotively generated internal voltage e and the internal voltage u above the minimum speed are respectively boosted by a factor F of maximally 1.22.

Figure 4:
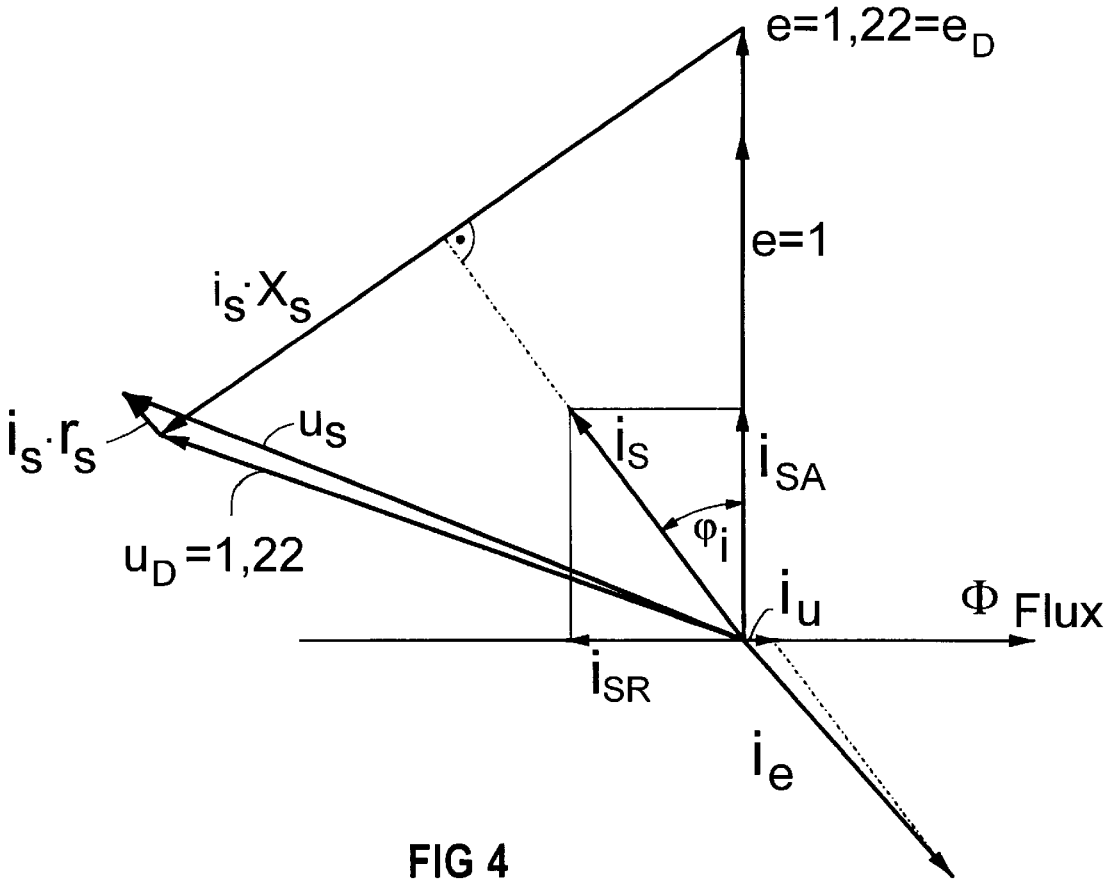
FIG. 4 illustrates a vector diagram for the point of the highest speed for a synchronous motor with a great range of speed regulation given regulation in accordance with the invention.

FIG. 4 illustrates the determination for the limit case of 35°. As the illustration shows, it is assumed that the external terminal voltage us is at least selected of such a size that the ohmic voltage drop $i_s \cdot r_s$ is also covered, and such that the excitation current $i_e$ is set of such a size that the demagnetizing effect of the reactive stator current component $i_{SR}$ is compensated and a required, imaginary magnetization current $i_\mu$, results.

On the basis of the described determination, how large the relative stator reactance is allowed to be can be calculated as follows:

$$x_s = \frac{n_{min}}{n_{max}} \cdot \frac{P_{(min)}}{P_{s(max)}} \cdot \sqrt{2}$$

$n_{min}$ is thereby the minimum speed, $n_{max}$ the maximum speed, $P_{(min)}$ is the continuous output at $n_{min}$, and $P_{S(max)}$ the desired short-term output at $n_{max}$.

As an example, given $n_{max}=8 \cdot n_{min}$(range 1:8) and $P_{s(max)}=2.0 \cdot P_{(min)}$then $x_s=0.088$.

The available maximum active output according to FIG. 4 derives from the product of the active component of the stator current $i_{SA}$ and the internal voltage e. The following output is available with the maximum shift angle $\phi_i$ of 35° given simultaneous boosting of the internal voltages u and e by the factor F=1.22: $P=\cos\phi_i \cdot i_S F \cdot e_{min}=0.82 \cdot i_S \cdot 1.22 \cdot e=i_S e_{(min)}$, whereby $e_{(min)}$ is the internal voltage e given minimum speed. With this determination, thus, 100% of the short-term output available at the minimum speed is available at the maximum speed.

It is also proposed that the provided voltage reserve (maximum 22%) be utilized in the lower speed range as well in order to boost the internal voltage e above the minimum speed proportionally to the speed given what continues to be full magnetic flux, up to the internal voltage ed that is reached with the maximally usable frequency converter voltage at the speed $n_D$. Given an unchanging stator current, one thus obtains a power characteristic of non-constant power output, for example according to FIG. 5. Even given a synchronous motor, a design rating $P_D$ derives at the speed $n_D$ according to this method that lies above the continuous output $P_{(min)}$ at the minimum speed in a broad speed range.

Figure 5:
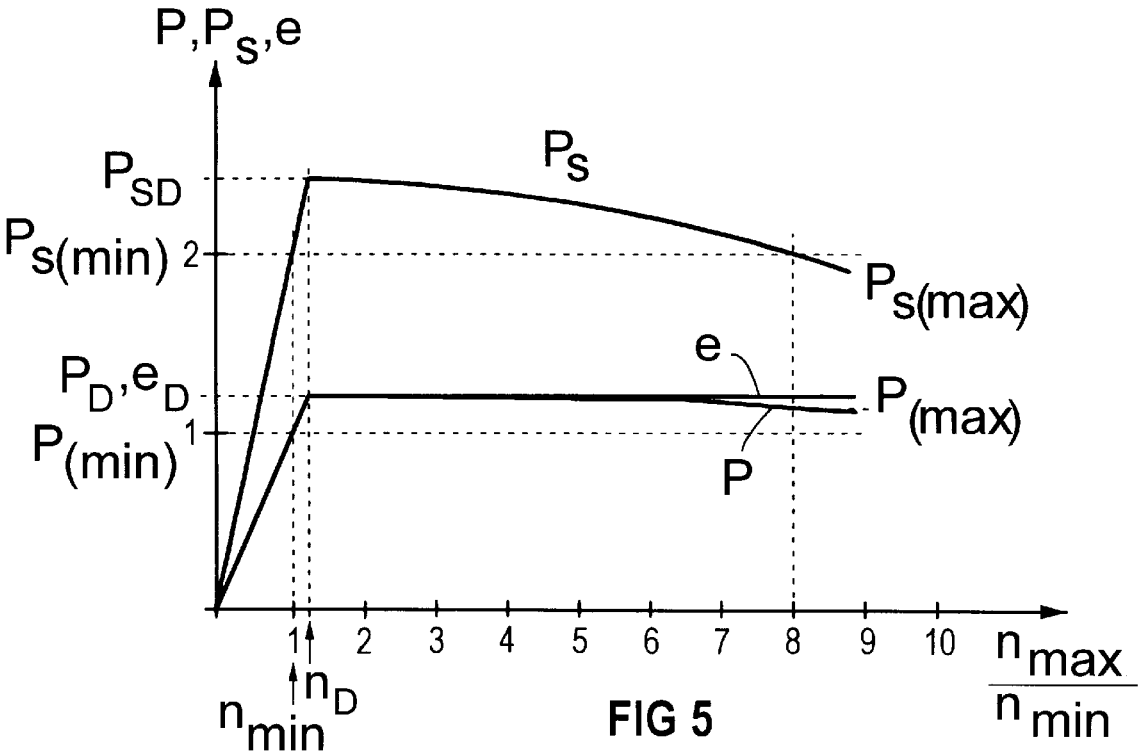
FIG. 5 illustrates an output characteristic of a synchronous motor given regulation in accordance with the invention.

The example of FIG. 5 is based on that at least 2 times the continuous output being briefly available over a range of control of 1:8.

The disclosed solution allows the utilized power reserve to be selected as small as possible according to the factor F and to be utilized as fully as possible.

Figure 3:
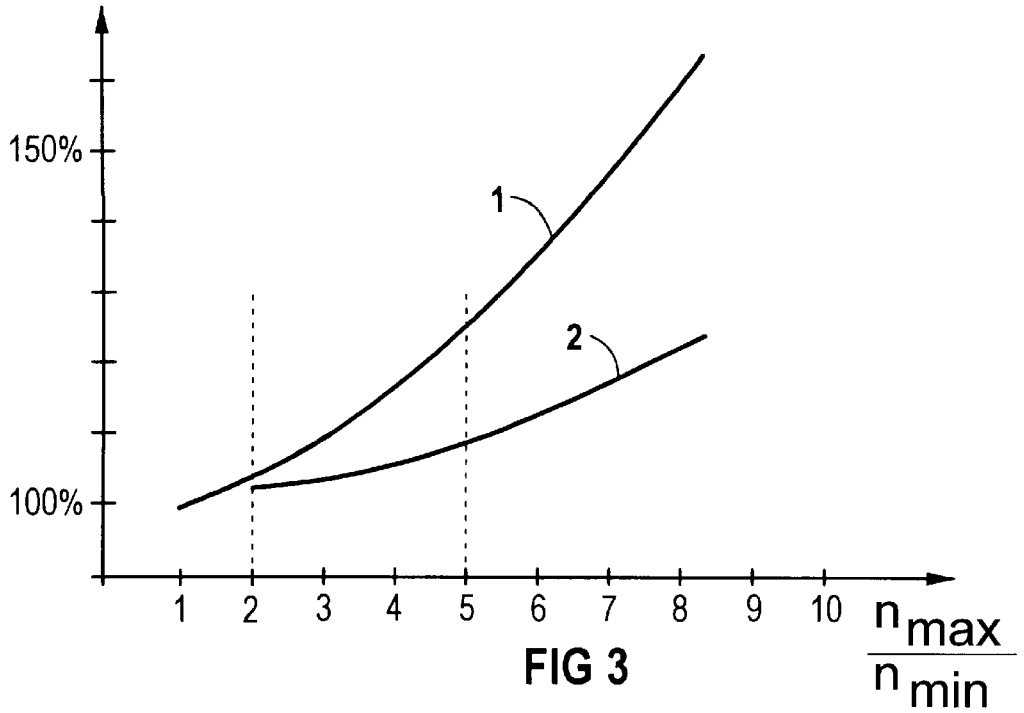
FIG. 3 illustrates relative expenses which depend on the ratio of maximum to minimum speed, with reference to a drive motor for a cold-rolling mill.

With reference to the example of FIG. 3, reference numeral 2 shows the curve of the expenditures dependent on the ratio of maximum speed to minimum speed for a synchronous motor of the invention compared to the curve (reference numeral 1) for an induction motor of the prior art.

The curve of the expenditures dependent on the ratio of maximum speed to minimum speed for a synchronous motor according to reference numeral 2 also makes it clear that the invention can be especially efficiently employed for a speed range from 1:2 to 1:5.

Although modifications and changes may be suggested by those skilled in the art, it is the intention of the inventors to embody within the patent warranted hereon all changes and modifications as reasonably and properly come within the scope of their contribution to the art.

I claim:

1. A mill train comprising:

at least one roll stand for rolling rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the ratio of the maximum speed ($n_{max}$) to the minimum speed ($n_{min}$) lies within the range 2.0 and 8.0;

wherein the motor has a power output between the minimum speed ($n_{min}$) and the maximum speed ($n_{max}$) that deviates from the continuous output of the motor at the minimum speed;

wherein the motor is a synchronous motor that can be overloaded; and wherein the phase position of the stator current ($I_s$) is set such that at the maximum speed, the same phase angle is formed between the stator current ($I_s$) and the electromotively generated internal voltage (e) as between the stator current ($I_s$) and an imaginary internal voltage (u), whereby the internal voltage (u) is formed as a counter-voltage for covering the vectorial sum of the voltages independent of active loss, namely of the internal voltage (e) and the inductive voltage drop ($i_s \cdot s_x$).

2. A mill train comprising:

at least one roll stand for rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the ratio of the maximum speed ($n_{max}$) to the minimum speed ($n_{min}$) lies within the range 2.0 and 8.0; and wherein the motor has a power output between the minimum speed ($n_{min}$) and the maximum speed ($n_{max}$) that deviates from the continuous output of the motor at the minimum speed;

wherein the motor is a synchronous motor that can be overloaded; and wherein the motor is driven by an energizing power converter and on the basis of a frequency converter that can vary frequency, voltage and phase position of the voltage in the output; a regulator of the motor regulates the internal voltage of the motor such that above the minimum speed given full magnetic flux, the internal voltage (e) is boosted further corresponding to the existing voltage reserve dependent on the speed, up to an internal voltage ($e_s$) that is reached at the highest usable voltage of the frequency converter at the speed ($n_D$) that enables the maximum continuous power output ($P_D$).

3. A mill train comprising:

at least one roll stand for rolling rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the ratio of the maximum speed ($n_{max}$) to the minimum speed ($n_{min}$) lies within the range 2.0 and 8.0;

wherein the motor has a power output between the minimum speed ($n_{min}$) and the maximum speed ($n_{max}$) that deviates from the continuous output of the motor at the minimum speed;

wherein the motor is an induction motor that can be overloaded; and wherein, the motor is operated on the basis of a frequency converter that can vary frequency, voltage and phase position of the voltage at the output; the motor is operated with a voltage reserve for covering internal voltage drops-off at maximum speed and maximum load; and motor internal voltage (e) is boosted further corresponding to the respectively existing voltage reserve above the minimum speed given full magnetic flux with increasing speed, up to an internal voltage ($e_D$) that is reached at the highest usable voltage of the frequency converter at a speed ($n_D$) and that enables the maximum continuous power output ($P_D$).

4. A mill train comprising:

at least one roll stand for rolling rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the ratio of the maximum speed ($n_{max}$) to the minimum speed ($n_{min}$) lies within the range 2.0 and 8.0;

wherein the motor has a power output between the minimum speed ($n_{min}$) and the maximum speed ($n_{max}$) that deviates from the continuous output of the motor at the minimum speed; and wherein the internal voltage drop ($i_s \cdot X_s$) at the maximum speed is limited to $\sqrt{2}$·times the internal voltage (e); and in that the internal voltage (e) and the internal voltage (u) above the minimum speed are respectively boosted by a factor F of maximally 1.22, whereby $X_s$ is the reactance and $i_s$ is the stator current of the A.C. motor.

5. A mill train comprising:

at least one roll stand for rolling rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the motor is a synchronous motor that can be overloaded;

wherein the ratio of the maximum speed ($n_{max}$) to the minimum speed ($n_{min}$) lies within the range 2.0 and 8.0;

wherein the motor has a power output between the minimum speed ($n_{min}$) and the maximum speed ($n_{max}$) that deviates from the continuous output of the motor at the minimum speed;

wherein the phase position of the stator current ($I_s$) is set with the regulation of the phase position of the stator current ($I_s$) of the synchronous motor such that a phase angle ($\phi_i$) between the stator current ($I_s$) and an electromotively generated internal voltage (e) that does justice to the speed and load demands, i.e. an internal shift angle is formed that is increased up to a maximum value; and wherein the internal shift angle ($\phi_i$) at the maximum speed is limited to a value less than equal to 40°.

6. A mill train comprising:

at least one roll stand for rolling rolling stock;

at least one A.C. motor operatively coupled to the roll stand to drive same; and a controller for controlling the motor, wherein the motor speed is adjustable between a minimum speed ($n_{min}$) and a maximum speed ($n_{max}$);

wherein the ratio of the maximum speed ($n_{max}$) to the minimum speed ($n_{min}$) lies within the range 2.0 and 8.0;

wherein the motor has a power output between the minimum speed ($n_{min}$) and the maximum speed ($n_{max}$) that deviates from the continuous output of the motor at the minimum speed;

wherein the motor power output is greater than the continuous power output ($P_{min}$) of the motor at its minimum speed ($n_{min}$);

wherein the phase position of the stator current ($I_s$) is set with the regulation of the phase position of the stator current ($I_s$) of the synchronous motor such that a phase angle ($\phi_i$) between the stator current ($I_s$) and an electromotively generated internal voltage (e) that does justice to the speed and load demands, i.e. an internal shift angle is formed that is increased up to a maximum value; and wherein the internal shift angle ($\phi_i$) at the maximum speed is limited to a value less than equal to 40°.

7. A mill train according to one of claims 1–6, characterized in that the motor power output is greater than the continuous power output ($P_{min}$) of the motor at its minimum speed ($n_{min}$).

8. A mill train according to one of claims 1–6, characterized in that the power output available in the range between the minimum speed ($n_{min}$) and a maximum speed ($n_{max}$) is variable.

9. A mill train according to one of claims 1–6, characterized in that the motor has a short-term power output ($P_s$) available that is greater than 1.5 times the continuous rated power output (P) of the motor.

10. A mill train according to one of claims 1–6, characterized in that the motor has a short-term power output ($P_s$) available that is greater than 1.75 times the continuous rated power output (P) of the motor.

11. A mill train according to one of claims 1–6, characterized in that the motor has a short-term power output ($P_s$) available that is greater than 2.0 times the continuous rated power output (P) of the motor.

12. A mill train according to one of claims 1–6, characterized in that the motor has a short-term power output ($P_s$) available that is greater than 2.25 times the continuous rated power output of the motor.

13. A mill train according to one of claims 1–6, characterized in that the motor includes a temperature monitoring system, whereby the power output of the motor is limited when its temperature exceeds a threshold.

14. A mill train according to one of claims 1–6, characterized in that, in the range between minimum and maximum speed, the motor has a continuous power output (P)above its continuous power output ($P_{min}$) at the minimum speed and a short-term power output ($P_s$) above its short-term power outputs($P_{s(min)}$) at the minimum speed, whereby the ratio of maximum speed to minimum speed lies between 2.0 and 5.0.

15. A mill train according to one of claims 1–6, characterized in that, in the speed range between the minimum speed and the maximum speed ($n_{max}$), the motor has a continuous power output (P) available that is greater than the continuous power output ($P_{(min)}$) of the motor at the minimum speed ($n_{min}$) and that is greater than the continuous power output ($P_{(max)}$) of the motor at the maximum speed ($n_{max}$), whereby the continuous power output at maximum speed is greater than or equal to the continuous power output at minimum speed.

16. A mill train according to one of claims 1–6, characterized in that whether the speed range from the minimum speed ($n_{min}$) to maximum speed ($n_{max}$), the motor has a short-term power output ($P_s$) available that is greater than the short-term power output ($P_{s(min)}$) of the motor at the minimum speed ($n_{min}$) whereby the short-term power output ($P_{s(max)}$) of the motor at the maximum speed is equal to or less than the short-term power output at minimum speed.

17. A mill train according to one of claims 1–6, wherein the motor is operated on the basis of an excitation power converter and on the basis of a frequency converter that can vary frequency, voltage and phase position of the voltage; and is regulated to an optimum active load output by a variable shift angle ($\phi_i$) between internal voltage and the stator current ($I_s$) of the motor.

18. A mill train according to one of claims 1–4, characterized in that the phase position of the stator current ($I_s$) is set with the regulation of the phase position of the stator current ($I_s$) of the synchronous motor such that a phase angle ($\phi_i$) between the stator current ($I_s$) and an electromotively generated internal voltage (e) that does justice to the speed and load demands, i.e. an internal shift angle is formed that is increased up to a maximum value.

19. A mill train according to one of claims 1–4, wherein the phase position of the stator current ($I_s$) is set such that at the maximum speed, the same phase angle is formed between the stator current ($I_s$) and the electromotively generated internal voltage (e) as between the stator current ($I_s$) and an imaginary internal voltage (u), whereby the internal voltage (u) is formed as a counter-voltage for covering the vectorial sum of the voltages independent of active loss, namely of the internal voltage (e) and the inductive voltage drop ($i_s \cdot s_x$).

20. A mill train according to claim 17, wherein the internal shift angle ($\phi_i$) at the maximum speed is limited to a value less than equal to 40°.

21. A mill train according to one of claims 5–6, wherein the internal shift angle at the maximum speed is limited to a value equal to or less than 35°.

22. A mill train according to one of claims 1–6, wherein the internal voltage drop ($i_s \cdot X_s$) at the maximum speed is limited to $\sqrt{2}$·times the internal voltage (e); and in that the internal voltage (e) and the internal voltage (u) above the minimum speed are respectively boosted by a factor F of maximally 1.22, whereby $X_s$ is the reactance and $i_s$ is the stator current of the A.C. motor.

23. A mill train according to one of claims 1–6, comprising a plurality of roll stands for rolling rolling stock:

wherein the roll stands are each driven by at least one respective A.C. motor with at least three phases and whose speed for rolling the rolling stock is adjustable with a controller between a minimum speed ($n_{min}$) and a maximum speed ($n_{max}$) dependent on the properties of the rolling process;

wherein the ratio of maximum speed ($n_{max}$) to minimum speed ($n_{min}$) lies between 2.0 and 8.0;

wherein the A.C. motors make an output available to a selection of roll stands between the minimum speed and the maximum speed ($n_{max}$) that deviates from the continuous output of the A.C. motor at the minimum speed and that allows an optimum matching of the output made available by the A.C. motor to the requirements of the rolling process.

24. A mill train according to one of claims 1–6, comprising a plurality of roll stands for rolling rolling stock, wherein the roll stands are each driven by respective A.C. motors having at least three phases and whose speed for rolling the rolling stock is adjustable with a controller between a minimum speed ($n_{min}$) and a maximum speed ($n_{max}$) dependent on the properties of the rolling process;

wherein the ratio of maximum speed ($n_{max}$) to minimum speed ($n_{min}$) lies between 2.0 and 8.0;

wherein the A.C. motors make an output available to the last roll stand of the mill train between the minimum speed and the maximum speed ($n_{max}$) that deviates from the continuous output of the A.C. motor at the minimum speed and that allows an optimum matching of the output made available by the A.C. motor to the requirements of the rolling process.

25. A mill train according to one of claims 1–6, comprising a plurality of roll stands for rolling rolling stock, wherein the roll stands are each driven by respective A.C. motors having at least three phases and whose speed for rolling the rolling stock is adjustable with a controller between a minimum speed ($n_{min}$) and a maximum speed ($n_{max}$) dependent on the properties of the rolling process;

wherein the ratio of maximum speed ($n_{max}$) to minimum speed ($n_{min}$) lies between 2.0 and 8.0;

wherein the A.C. motors make an output available to all roll stands of the mill train between the minimum speed and the maximum speed ($n_{max}$) that deviates from the continuous output of the A.C. motor at the minimum speed and that allows an optimum matching of the output made available by the A.C. motor to the requirements of the rolling process.

26. The mill train according to any of claims 1–6, wherein the A.C. motor has at least three phases.

* * * * *